US006676103B2

(12) United States Patent
Wood

(10) Patent No.: US 6,676,103 B2
(45) Date of Patent: Jan. 13, 2004

(54) WIRELINE CENTRALIZATION APPARATUS AND METHOD

(75) Inventor: Carl Wood, Kemnay (GB)

(73) Assignee: Elmar Services Limited, Aberdeen (GB)

( * ) Notice: Subject to any disclaimer, the term of this patent is extended or adjusted under 35 U.S.C. 154(b) by 0 days.

(21) Appl. No.: 09/949,094

(22) Filed: Sep. 7, 2001

(65) Prior Publication Data

US 2002/0070016 A1 Jun. 13, 2002

(30) Foreign Application Priority Data

Sep. 9, 2000 (GB) ..... 0022157

(51) Int. Cl.[7] ..... E21B 29/08
(52) U.S. Cl. ..... 251/1.3; 277/325
(58) Field of Search ..... 251/1.1, 1.3; 277/322, 277/324, 325

(56) References Cited

U.S. PATENT DOCUMENTS

| | | | | |
|---|---|---|---|---|
| 3,692,316 A | | 9/1972 | Bishop et al. | |
| 3,880,436 A | * | 4/1975 | Canal | 277/325 |
| 4,372,527 A | * | 2/1983 | Rosenhauch et al. | 251/1.3 |
| 4,506,858 A | * | 3/1985 | Gentry | 277/325 |
| 5,125,620 A | * | 6/1992 | Young | 251/1.3 |
| 5,127,623 A | * | 7/1992 | McDugle | 251/1.3 |
| 5,287,879 A | | 2/1994 | Leggett et al. | |
| 5,294,088 A | * | 3/1994 | McWhorter et al. | 251/1.3 |
| 5,575,451 A | * | 11/1996 | Colvin et al. | 251/1.3 |
| 5,603,481 A | * | 2/1997 | Parker et al. | 251/1.3 |
| 5,833,208 A | * | 11/1998 | Lee, Jr. | 251/1.3 |

FOREIGN PATENT DOCUMENTS

| | | |
|---|---|---|
| GB | 2 185 051 A | 7/1987 |
| GB | 2 284 840 A | 6/1995 |
| WO | WO 99/46525 | 9/1999 |

OTHER PUBLICATIONS

UK Search Report.
EP Search Report, Oct. 9, 2002.

* cited by examiner

*Primary Examiner*—Gene Mancene
*Assistant Examiner*—Eric Keasel
(74) *Attorney, Agent, or Firm*—Jenkens & Gilchrist, P.C.

(57) ABSTRACT

An apparatus (10, 50) for moving an elongate member (102) (such as a wireline (102)) which passes through a through-bore (70, 97) of a valve device such as a wireline valve used in the hydrocarbon production industry is provided. The apparatus includes an upper movement mechanism (18, 58; 91A, 91B; 116) and a lower movement mechanism (20, 60; 91A, 91B; 112) spaced apart about a portion of the valve device (70, 97). The upper (18, 58; 91A, 91B; 116) and lower (20, 60; 91A, 91B; 112) movement mechanisms are actuable such that they are capable of moving the elongate member (102) into a pre-determined position (70, 97), which is typically co-incident with the longitudinal axis of the valve device.

27 Claims, 16 Drawing Sheets

SECTION A-A

SECTION A-A

WIRELINE CENTRALIZATION APPARATUS AND METHOD

PRIOR RELATED APPLICATIONS

This application claims priority to prior foreign application No. UK 0022157.2, filed Sep. 9, 2000.

FEDERALLY SPONSORED RESEARCH STATEMENT

Not applicable.

REFERENCE TO MICROFICHE APPENDIX

Not applicable.

FIELD OF THE INVENTION

The present invention relates to apparatus and methods for use in wireline valves or, particularly but not exclusively used in the oil and gas industries.

BACKGROUND OF THE INVENTION

Conventionally, ram assemblies are used inside a wireline intervention product called a wireline valve, and the sole purpose of ram assemblies is to provide a safety barrier against well pressure whilst remedial work is carried out on the wire. Such remedial work may be required if for example, the wire has a broken strand or has "bird caged" which causes the wire to get jammed in another piece of equipment, such as a greasehead which is located at the top of the intervention string above the wireline valve. In such a scenario, the only known solutions to this problem are either to chop the wire and fish it out afterwards or to seal around the wire below the problem area. A wireline valve is used to perform the latter solution.

The high pressures inside the well mean that, conventionally, the only reliable way to achieve a seal in the wireline valve is with rubber seals mounted on the inner most faces of the ram assemblies. A middle portion of the outer surface of the rubber seals comprise a recess which conforms to the outer surface of the wireline, and grease is pumped into the inner armours of the wireline; the viscosity of the grease drops the pressure within the inner armours. However, at these high pressures, rubber tends to behave like a fluid and as such needs something to prevent it being flushed away by the pressure. The common solution to this problem is the use of steel plates which retain the rubber in place. Therefore, the wireline has to be brought into a specific area of the ram seal so that when the ram assemblies are closed, the remaining rubber that is not involved in sealing around the wire is also backed up by steel. Currently this is achieved by guiding the wire into the middle of the well bore where the recess in the ram seal is located.

There are three main different types of mechanism for guiding the wire into the middle of the well bore, these being:

1) Flat plate replaceable guide rams, as shown in FIG. 1. These were the first type of guides to be offered in the market place and are probably the most straightforward to manufacture. However they suffer the disadvantage that the guides cannot, under certain geometry's, be made to pick up a wire located at the edge of the through bore, and there is also a possibility that the guides could be dropped down the well;
2) Curved replaceable guide rams, as shown in FIG. 2. These rams have curved guides allowing them to pick up the wireline from the very edge of the throughbore of the wireline valve. However, they also suffer from the disadvantage that the guides could be dropped down the well; and
3) Integral guide rams, as shown in FIG. 3. These rams have the guides formed integrally with the ram assemblies, and were produced to solve the problems of bits dropping down the well as discussed in 1) and 2) above. These rams also provide greater mechanical strength to the ram assembly when closed, as the guide fingers interlock in the opposing ram bore creating a span beam in bending rather than a cantilevered beam. This has allowed the use of these integral guide rams in higher pressure wireline valves such as 15000 p.s.i. sets. However, these rams suffer from the disadvantage that they are expensive to manufacture, due to the more complex machining required.

Recently, there has been a significant increase in the number of incidents where the ram assemblies of various wireline valves have been closed and, instead of guiding the wire and sealing around the wire, the ram assemblies have crushed or completely cut the wireline. This is obviously not acceptable.

Extensive testing has shown that under certain conditions of wire tension and angle through the wireline valve, all of the above ram types 1), 2) and 3) may crush or cut the wireline and it has also been determined that none of them will guide a slack wire into the correct position.

SUMMARY OF THE INVENTION

In accordance with a first aspect of the present invention, there is provided an apparatus for moving an elongate member which passes through a throughbore of a valve device, the apparatus comprising an upper movement mechanism and a lower movement mechanism spaced apart about a portion of the valve device, the upper and lower movement mechanisms being actuable such that the elongate member is moved into a pre-determined position.

In accordance with a second aspect of the present invention, there is provided a method of moving an elongate member which passes through a throughbore of a valve device, the method comprising providing an upper movement mechanism and a lower movement mechanism spaced apart about a portion of the valve device, the upper and lower movement mechanisms being actuable such that the elongate member is moved into a pre-determined position, and actuating the upper and lower movement mechanisms.

The elongate member is typically a wireline, logging line, cable or the like. The predetermined position is typically a position substantially parallel to a longitudinal axis of the valve device and more preferably is substantially co-incident with the longitudinal axis of the valve device, such that the upper and lower movement mechanism are preferably respective upper and lower centralising mechanisms.

In a preferred embodiment, the upper centralising mechanism comprises at least one pair of guide arms which are adapted to move the elongate member toward the longitudinal axis, typically upon movement of the guide arms in a direction substantially perpendicular to the longitudinal axis of the valve device.

More preferably, the upper centralising mechanism comprises two pairs of said guide arms. Typically, one pair of guide arms of the upper centralising mechanism are provided on a first ram assembly, and a second pair of guide arms of the upper centralising mechanism are provided on a second ram assembly. Typically, the first and second ram assemblies are arranged substantially diametrically opposite one another about the longitudinal axis of the throughbore. Preferably, each of the pair of guide arms of the upper centralising mechanism are arranged about a recess adapted to accept the elongate member therein, and more preferably, each of the pair of guide arms taper outwardly at an angle from the longitudinal axis of the respective ram assembly, where said angle may be in the region of 60° to 45°. Preferably, each pair of guide arms of the upper centralising mechanism taper outwardly to an extent at least as great, and preferably greater than, the diameter of the throughbore of the valve device.

More preferably, the lower centralising mechanism comprises two pairs of said guide arms. Typically, one pair of guide arms of the lower centralising mechanism are provided on a first ram assembly, and a second pair of guide arms of the lower centralising mechanism are provided on a second ram assembly. Typically, the first and second ram assemblies are arranged substantially diametrically opposite one another about the longitudinal axis of the throughbore. Preferably, each of the pair of guide arms of the lower centralising mechanism are arranged about a recess adapted to accept the elongate member therein, and more preferably, each of the pair of guide arms taper outwardly at an angle from the longitudinal axis of the respective ram assembly, where said angle may be in the region of 60° to 45°. Preferably, each pair of guide arms of the lower centralising mechanism taper outwardly to an extent at least as great, and preferably greater than, the diameter of the throughbore of the valve device.

The pair of guide arms of the upper centralising mechanism of one of the ram assemblies is preferably arranged to butt against a portion of the pair of guide arms of the upper centralising mechanism of the other of the ram assemblies, and more preferably, is arranged to butt against in a close fitting manner. Typically, a surface of the pair of guide arms of the upper centralising mechanism of one of the ram assemblies is preferably arranged to be a sliding fit with a surface of the pair of guide arms of the upper centralising mechanism of the other of the ram assemblies. The sliding fit arrangement provides the advantage that, as the guide arms are brought together, the elongate member is denied the opportunity to be trapped between the two sliding surfaces.

The pair of guide arms of the lower centralising mechanism of one of the ram assemblies is preferably arranged to butt against a portion of the pair of guide arms of the lower centralising mechanism of the other of the ram assemblies, and more preferably, is arranged to butt against in a close fitting manner. Typically, a surface of the pair of guide arms of the lower centralising mechanism of one of the ram assemblies is preferably arranged to be a sliding fit with a surface of the pair of guide arms of the lower centralising mechanism of the other of the ram assemblies.

Typically, the recesses of the upper centralising mechanism and the recesses of the lower centralising mechanism are arranged to be coincident with the longitudinal axis of a recess of an inner sealing member of the valve device.

Most preferably, each of the pair of ram assemblies comprises an upper and lower centralising mechanism. Typically, the upper and lower centralising mechanism are located immediately about an inner sealing member of the wireline valve.

In an alternative embodiment, the upper, and preferably the lower, centralising mechanism comprises a pair of rotatable guide arms which are adapted to move the elongate member toward the longitudinal axis. Typically, each rotatable guide arm comprises a substantially semi-cylindrical guide arm which may be rotated about its diameter, such that rotation of the pair of guide arms toward one another causes the elongate member to move toward the longitudinal axis of the throughbore of the valve device. Typically, the upper centralising mechanism is formed within a tubular member which can be coupled to the upper end of the valve device. Typically, the lower centralising mechanism is formed within a tubular member which can be coupled to the lower end of the valve device.

In a further alternative embodiment, the upper, and preferably the lower, centralising mechanism comprises a pair of moveable members coupled to one another by a linkage mechanism such that rotation of one of the moveable members relative to the other causes the other moveable member to move toward the rotating moveable member, and also causes the linkage mechanism to move toward one another at their centre point, and are adapted to move the elongate member toward the longitudinal axis of the through bore of the valve device. Typically, the upper centralising mechanism is formed within a member having a substantially cylindrical throughbore, wherein the member can be coupled to the upper end of the valve device. Typically, the lower centralising mechanism is formed within a member having a substantially cylindrical throughbore, wherein the member can be coupled to the lower end of the valve device.

In a yet further alternative embodiment, the upper centralising mechanism is provided within a member having a substantially cylindrical throughbore, wherein the member can be coupled to the upper end of the valve device. Typically, the lower centralising mechanism is formed within a member having a substantially cylindrical throughbore, wherein the member can be coupled to the lower end of the valve device. Typically, the upper and lower centralising mechanism each comprise a plurality of moveable fingers coupled in the form of an iris of a camera, such that upon actuation, the fingers reduce the cylindrical throughbore of the member to a size slightly larger than the diameter of the elongate member.

BRIEF DESCRIPTION OF THE DRAWINGS

Embodiments of the present invention will now be described, by way of example only, with reference to the accompanying drawings, in which:

FIG. 3(*b*) is a perspective view of a second prior art ram assembly, which only differs from that shown in FIG. 3(*a*) by the inclusion of a ram key, as discussed in 3) above.

FIG. 4(*b*) is a bottom view of the ram assembly of FIG. 4(*a*).

FIG. 4(*c*) is a side view of the ram assembly of FIG. 4(*a*).

FIG. 4(*d*) is a plan view of the ram assembly of FIG. 4(*a*).

FIG. 4(*e*) is a rear end view of the ram assembly of FIG. 4(*a*).

FIG. 4(*f*) is a sectional view through section A—A of FIG. 4(*c*).

FIG. 4(*g*) is a sectional view through section B—B of FIG. 4(*b*).

FIG. 4(*h*) is a sectional view through section C—C of FIG. 4(*c*).

FIG. 4(*i*) is a sectional view through section D—D of FIG. 4(*c*).

FIG. 5(*b*) is a plan view of the ram of FIG. 5(*a*).

FIG. 5(*c*) is a side view of the ram of FIG. 5(*a*).

FIG. 5(*d*) is a bottom view of the ram of FIG. 5(*a*).

FIG. 5(*e*) is a rear end view of the ram of FIG. 5(*a*).

FIG. 5(*f*) is a sectional view through section A—A of FIG. 5(*b*).

FIG. 5(*g*) is a sectional view through section B—B of the ram of FIG. 5(*c*).

FIG. 5(*h*) is a sectional view through section C—C of the ram of FIG. 5(*c*).

FIG. 5(*i*) is a sectional view through section D—D of the ram of FIG. 5(*d*).

FIG. 10(*b*) is a side view of a portion of the apparatus of FIG. 10(*a*).

FIG. 10(*c*) is a side view of a portion of the apparatus of FIG. 10(*b*) after actuation.

FIG. 11(*b*) is a side view of the apparatus of FIG. 11(*a*).

As discussed above, FIGS. 1, 2, 3(*a*) and 3(*b*) show prior art ram assemblies and are not in accordance with the present invention.

DESCRIPTION OF EMBODIMENTS OF THE INVENTION

FIG. 4(*a*) shows a first embodiment of a ram assembly 10 in accordance with the present invention. The first ram 10 should be considered for the sake of clarity as the right hand side ram 10.

The ram 10 comprises a rear face 12, and which is formed a slot 14, the purpose of which will be detailed subsequently.

Figure 1:
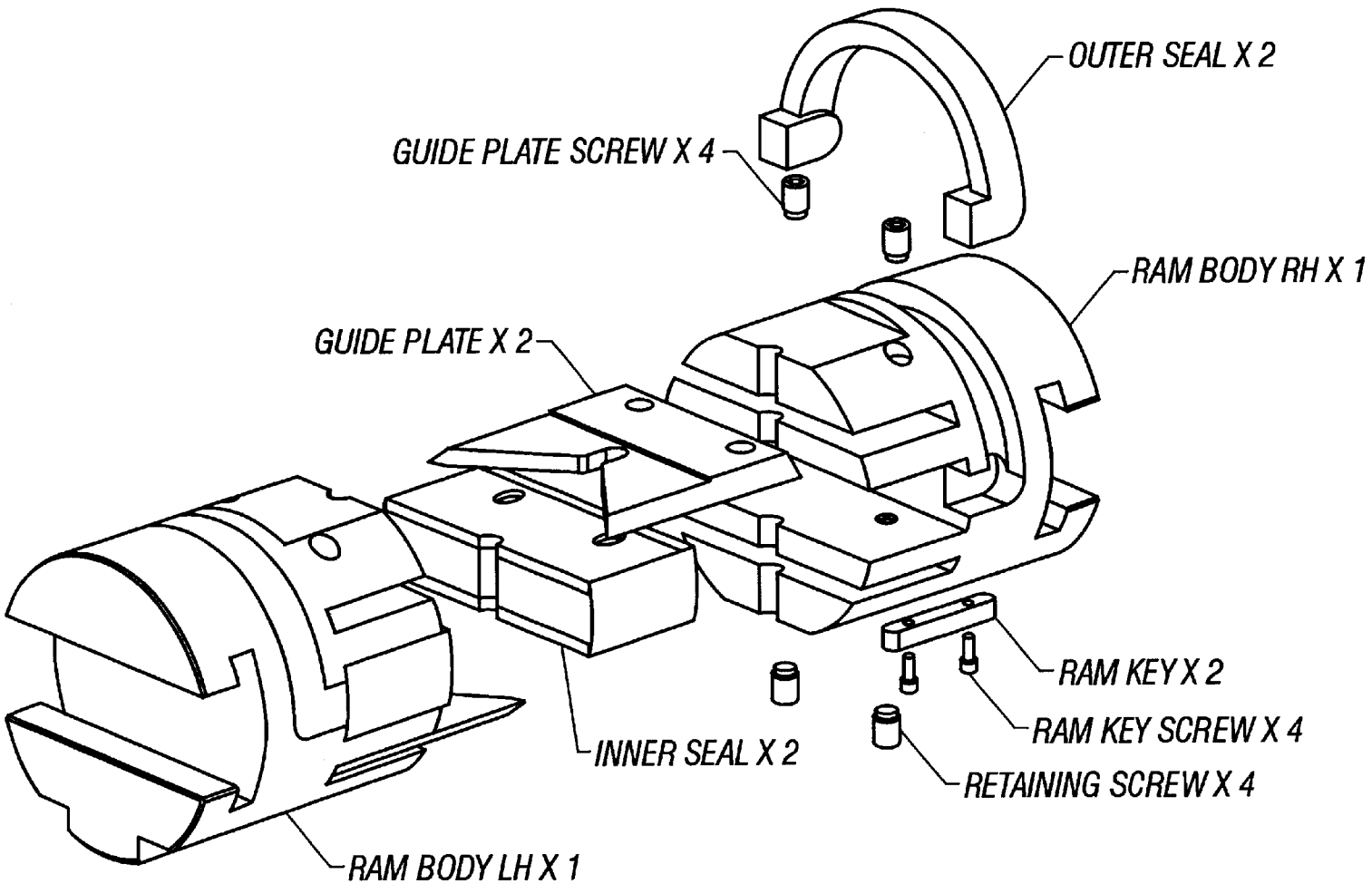
FIG. 1 (Prior Art)
FIG. 1 is a perspective view of a prior art ram assembly for a wireline valve as discussed in 1) above.
Figure 2:
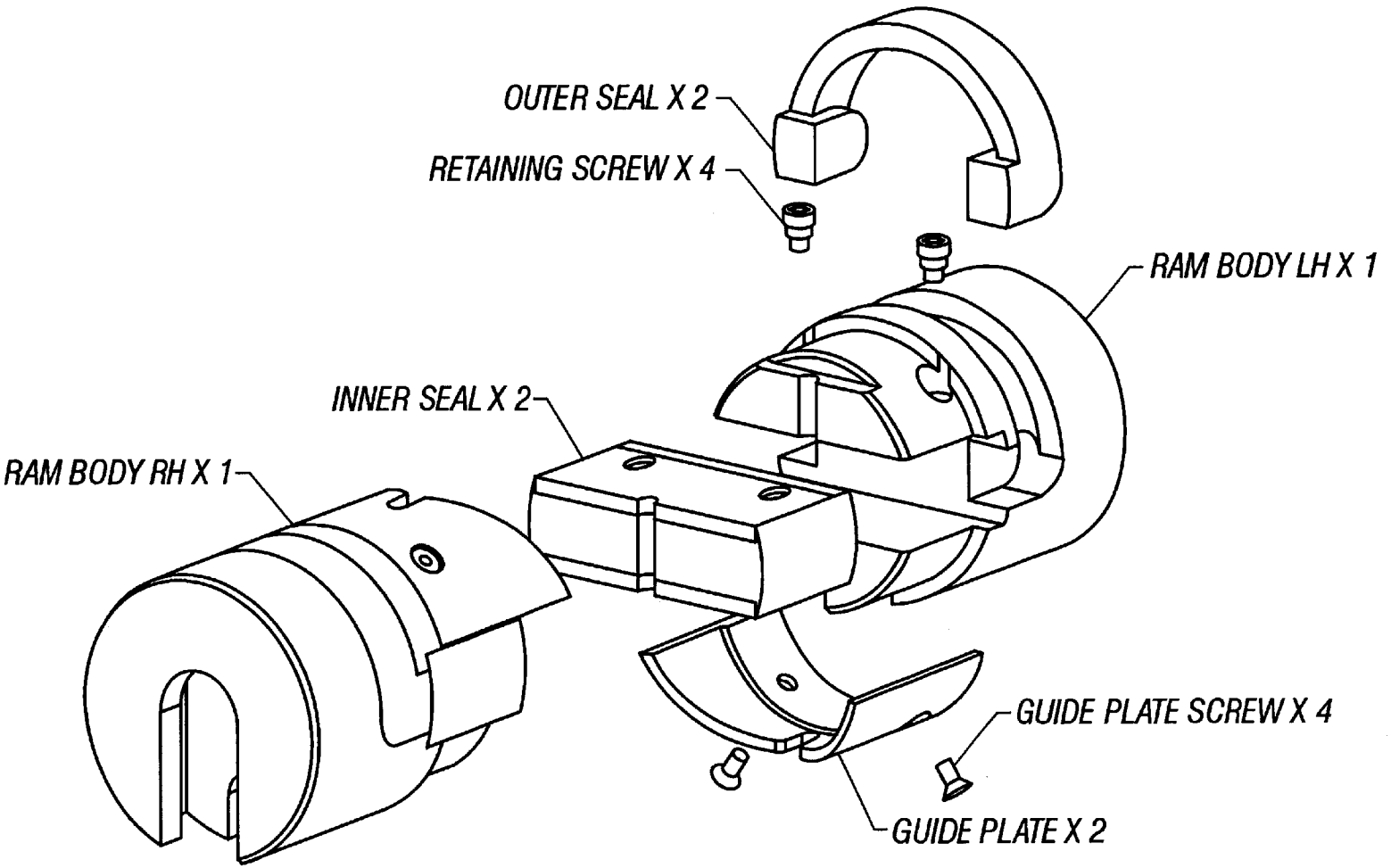
FIG. 2 (Prior Art)
FIG. 2 is a perspective view of a prior art ram assembly as discussed 2) above.
Figure 3A:
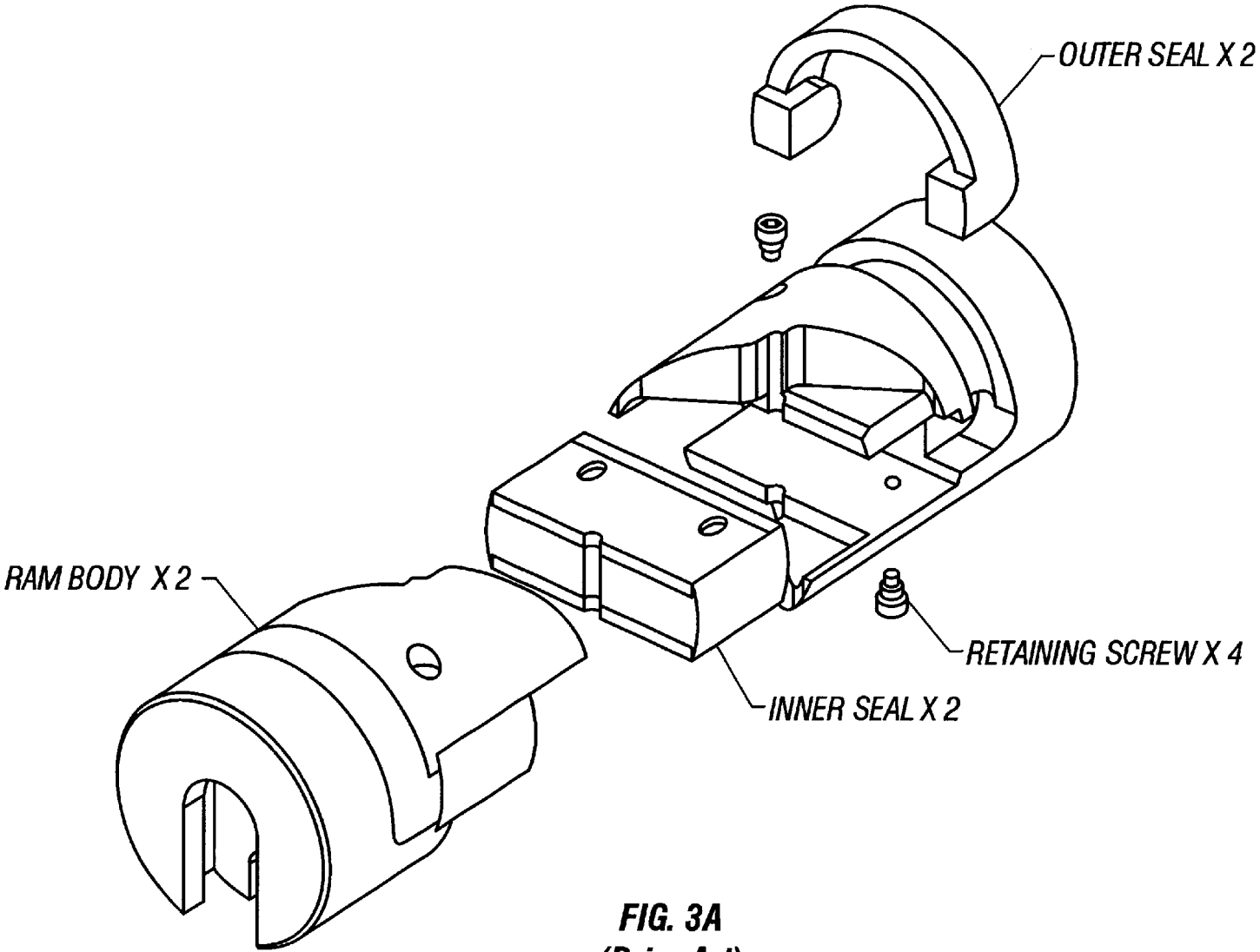
FIG. 3A (Prior Art)
FIG. 3(*a*) is a perspective view of a first prior art ram assembly as discussed in 3) above.
Figure 3B:
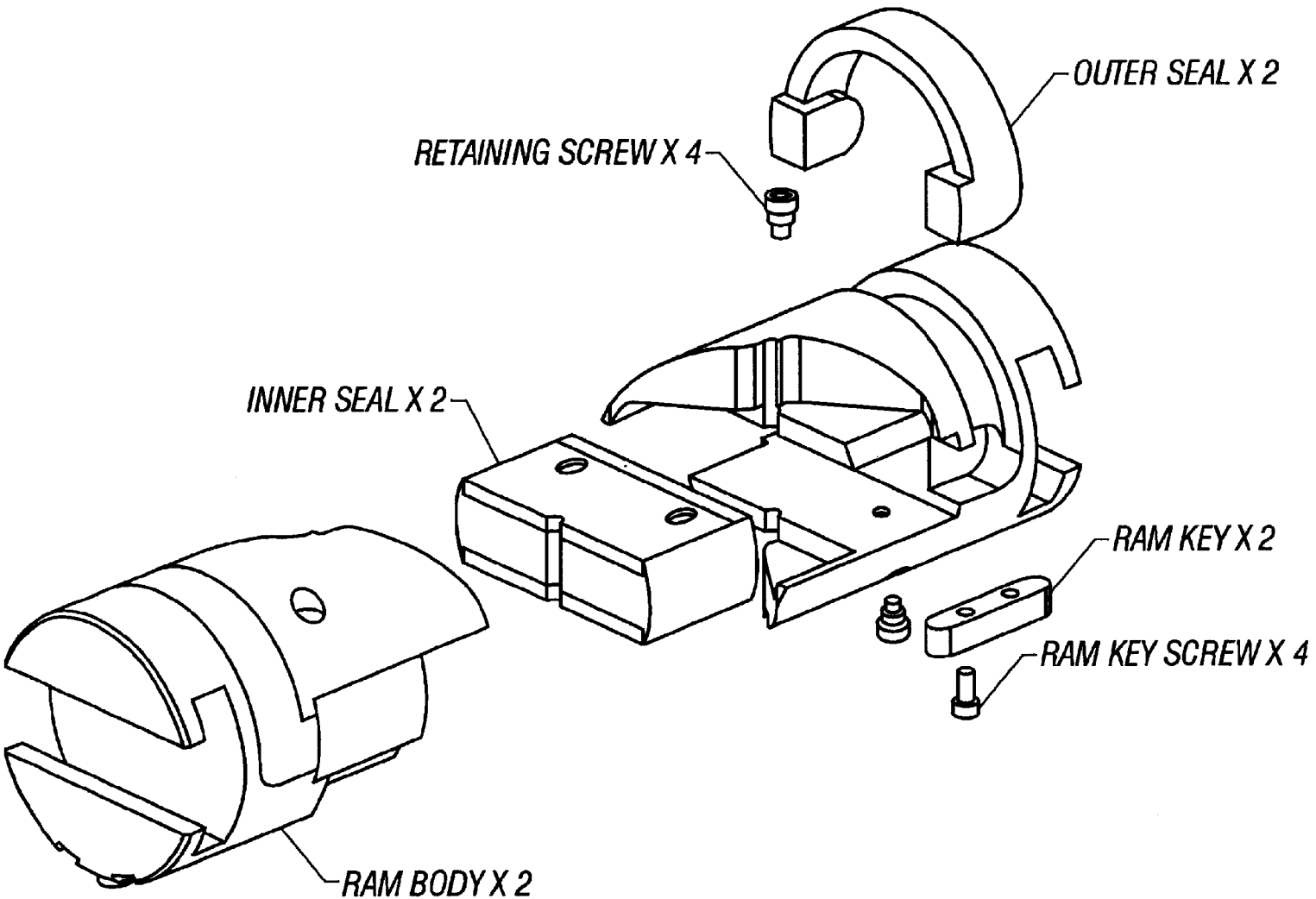
FIG. 3B (Prior Art)
Figure 4A:
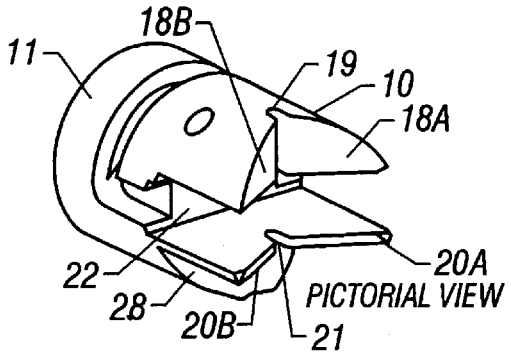
FIG. 4(*a*) is a perspective side view of a first ram assembly for a wireline valve in accordance with the present invention, intended for use with the ram assembly of FIGS. 5(*a*) to 5(*i*).
Figure 4B:
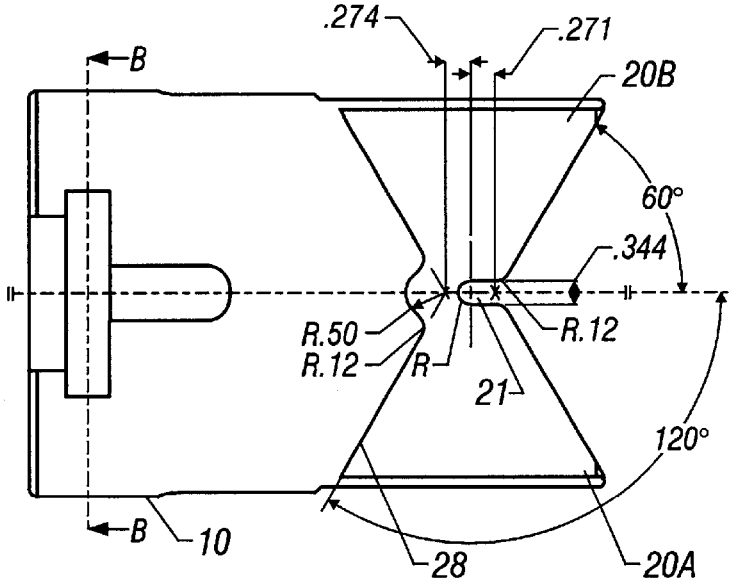
Figure 4C:
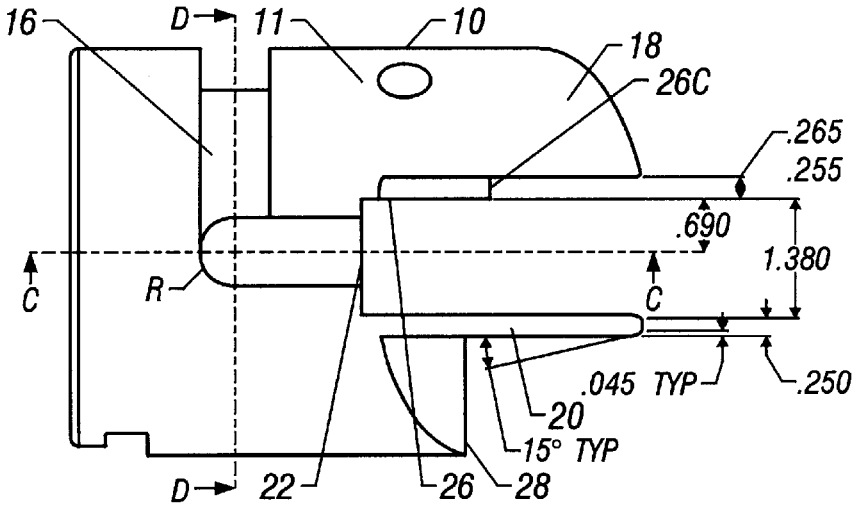
Figure 4D:
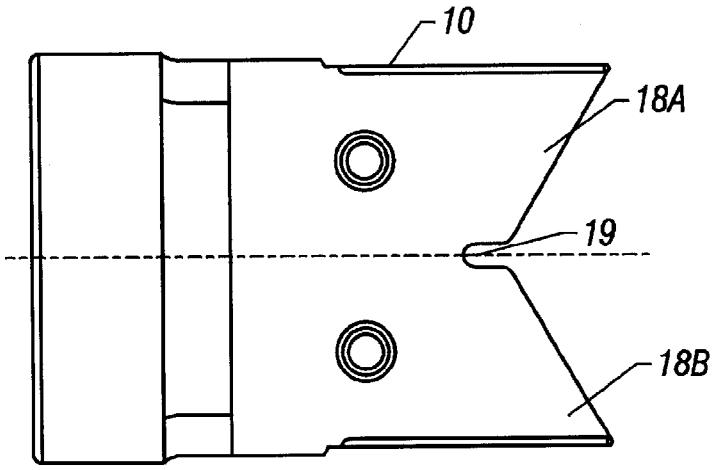
Figure 4E:
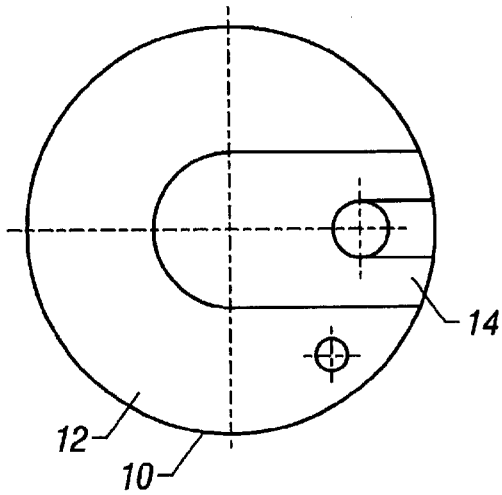
Figure 4F:
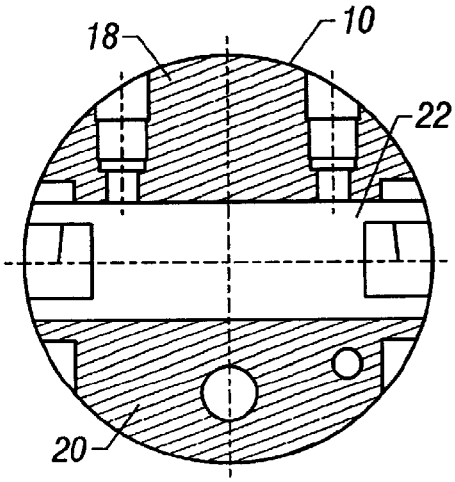
Figure 4G:
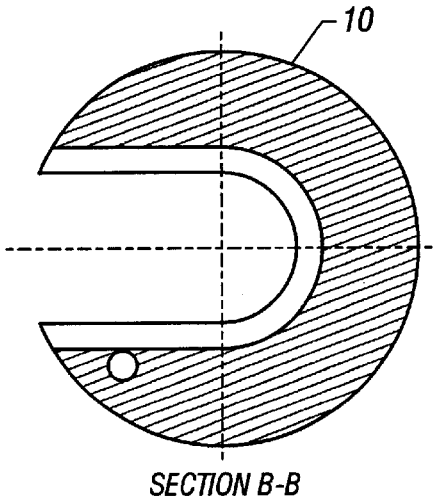
Figure 4H:
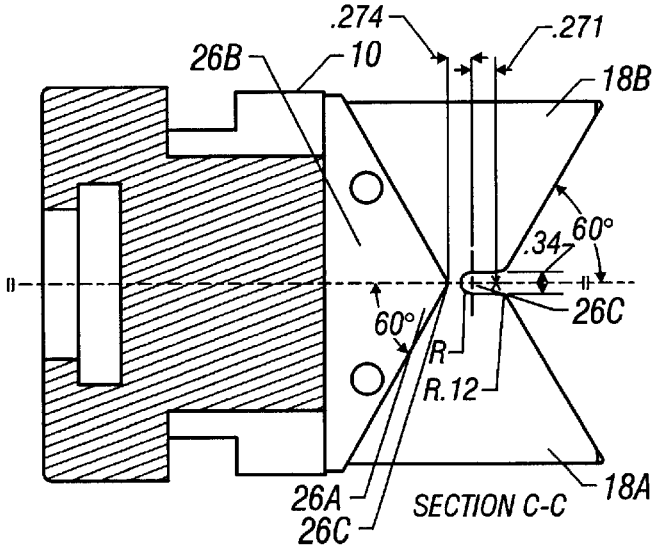
Figure 4I:
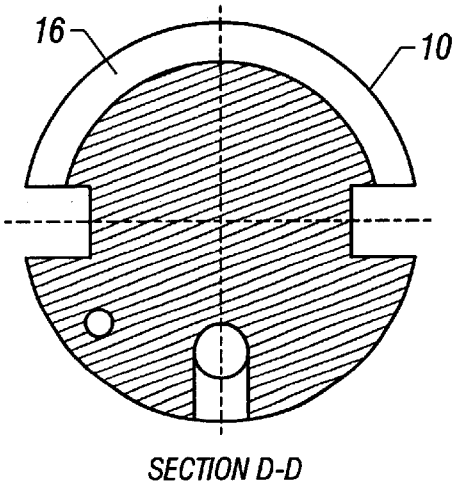
Figure 5A:
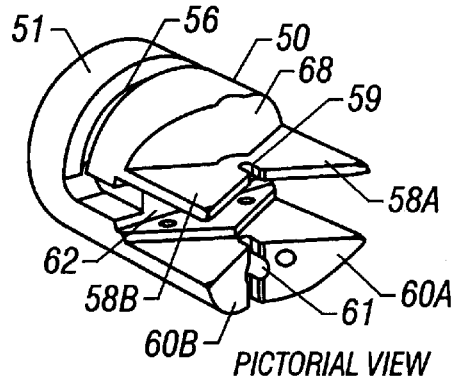
FIG. 5(*a*) is a perspective side view of a second ram assembly for a wireline valve in accordance with the present invention, intended for use with the ram assembly of FIGS. 4(*a*) to 4(*i*).
Figure 5B:
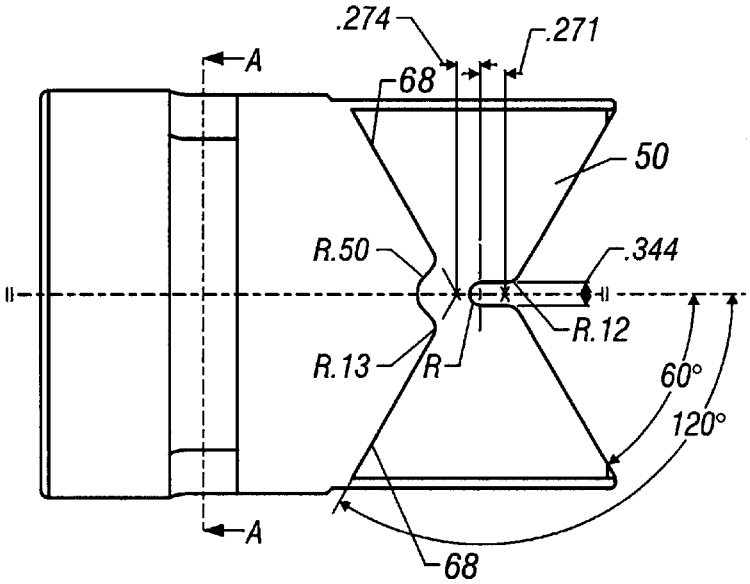
Figure 5C:
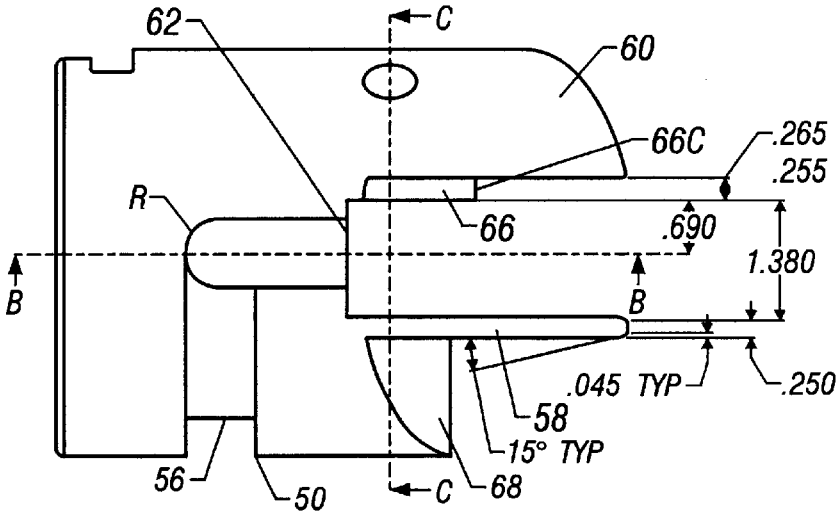
Figure 5D:
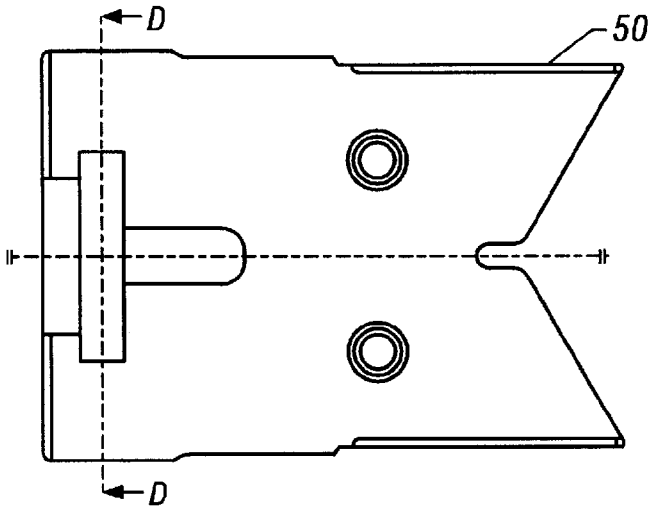
Figure 5E:
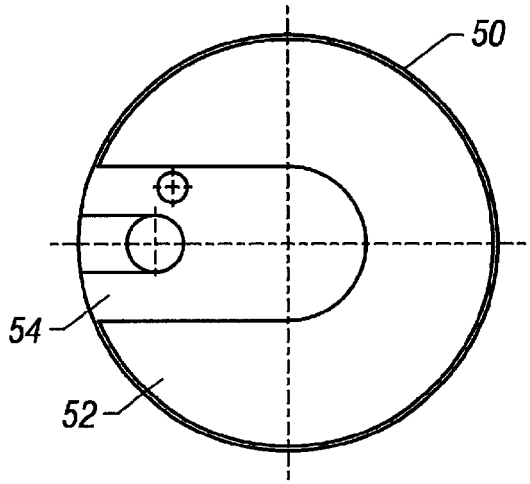
Figure 5F:
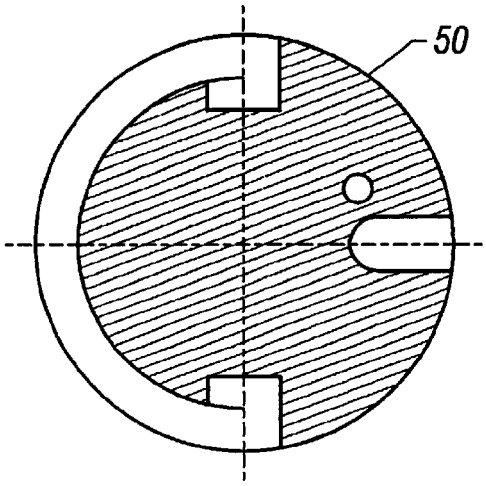
Figure 5G:
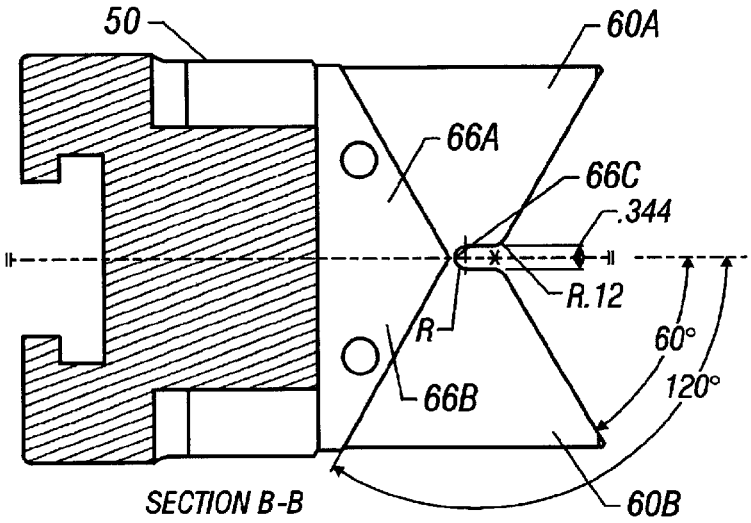
Figure 5H:
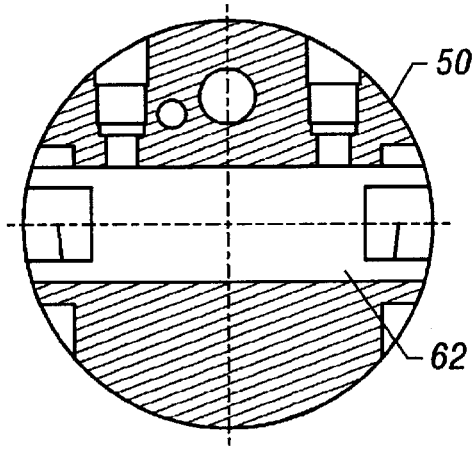
Figure 5I:
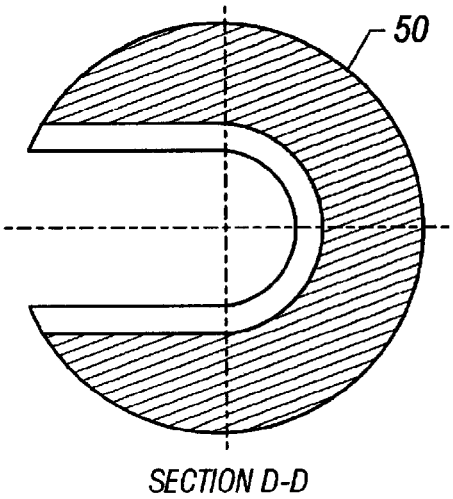

The body of the ram 10 is substantially cylindrical, and comprises a part circumferential seal slot 16 into which an outer seal (not shown in FIG. 4(*a*) to FIG. 4(*i*) but shown in FIGS. 1–3(*b*)) is placed.

The ram 10 comprises a pair of wireline guides 18, 20 which extend outwardly from an innermost end 22 of the cylindrical ram body 11. The upper surface of the upper wireline guide 18 is part circumferential, whilst the lowermost surface of the upper wireline guide 18 is planer and is parallel to the longitudinal axis of the cylindrical ram body 11.

The uppermost surface of the lower wireline guide 20 is planer, as is the lowermost surface of the lower wireline guide 20, with both the uppermost and lowermost surfaces of the lower wireline guide being parallel to the longitudinal axis of the cylindrical ram body 11.

A recess 19 is formed at the centre of the front face of the upper wireline guide 18, and the recess 19 is arranged to be perpendicular to the longitudinal axis of the cylindrical ram body 11. A recess 21 is also formed in the front face of the lower wireline guide 20 and is also arranged to be perpendicular to the longitudinal axis of the cylindrical ram body 11.

The front face of a left hand half 18A of the upper wireline guide 18 extends outwardly at an angle, which may be in the region of 60°, from the junction at which the left hand half 18A meets the recess 19, and the right hand half 18B of the upper wireline guide 18 also extends outwardly at an angle, which may be in the region of 60°, from the junction at which the right hand half 18B meets the recess 19.

The front face of a left hand half 20A of the lower wireline guide 20 extends outwardly at an angle, which may be in the region of 60°, from the junction at which the left hand half 20A meets the recess 21, and the right hand half 20B of the lower wireline guide 20 also extends outwardly at an angle, which may be in the region of 60°, from the junction at which the right hand half 20B meets the recess 21.

Thus, the upper 18 and lower 20 wireline guides provide "V" shaped guiding formations which, as will be described subsequently in use, will guide a wireline into the recesses 19, 21.

Figure 7:
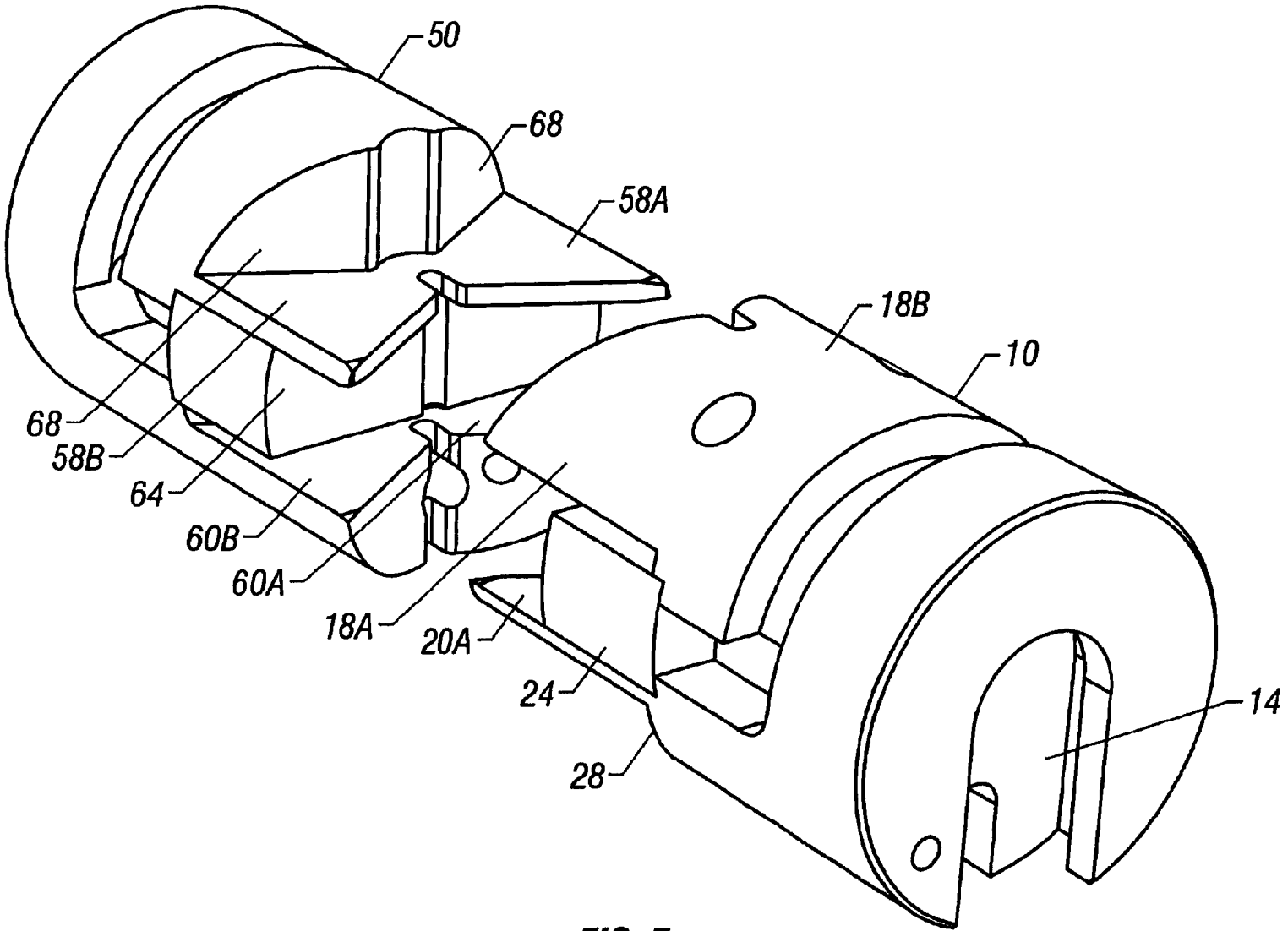
FIG. 7 is a detailed perspective view of the ram assemblies of FIG. 4(*a*) and FIG. 5(*a*) being brought together, but with the wireline valve omitted for clarity.

An inner seal (not shown in FIGS. 4(*a*) to 4(*i*) but shown in FIG. 7 as reference numeral 24) is located within the recess provided between the lowermost surface of upper wireline guide 18, uppermost face of lower wireline guide 20 and the innermost end 22. The inner seal 24 may be similar to the inner seal as shown in FIGS. 1 to 3(*b*), and comprises a rubber inner portion bounded by two metal plates which are bonded to the rubber portion during the manufacturing process thereof. The innermost face 25 of the inner seal 24 comprises a recess (hidden in FIG. 7) which is arranged to be perpendicular to the longitudinal axis of the cylindrical ram body 11, and which is arranged to be aligned with the pair of recesses 19, 21.

It should be noted that a spacer plate 26 is located between the lowermost surface of upper wireline guide 18 and the uppermost surface of the inner seal 24. The spacer plate 26 is arranged in two halves 26A, 26B which join at intersection 26C. The leading (innermost) face of the left hand half 26A tapers at an angle, which may be in the region of 60°, from intersection point 26C toward the innermost end 22, and the leading edge (innermost surface) of the right hand half 26B of the spacer plate 26, tapers at angle, which may be in the region of 60°, from the intersection point 26C toward the innermost end 22. The vertical depth of the spacer plate 26 is substantially identical to the vertical depth of an upper wireline guide 58 of the second (left hand) ram 50, which will now be described.

FIG. 5(*a*) shows a second embodiment of a ram assembly 50 in accordance with the present invention. The second ram 50 should be considered, for the sake of clarity, as the left hand side ram 50 when located in the wireline valve.

The ram 50 comprises a rear face 52, and which is formed a slot 54, the purpose of which will be detailed subsequently.

The body of the ram 50 is substantially cylindrical, and comprises a part circumferential seal slot 56 into which an outer seal (not shown in FIG. 5(*a*) to FIG. 5(*i*) but shown in FIGS. 1–3(*b*)) is placed.

The ram 50 comprises a pair of wireline guides 58, 60 which extend outwardly from an outermost (with respect to the centre of the throughbore of the wireline valve) end 52 of the cylindrical ram body 51. The uppermost surface of the upper wireline guide 58 is planer, as is the lowermost surface of the upper wireline guide 58, with both the uppermost and lowermost surfaces of the upper wireline guide 58 being parallel to the longitudinal axis of the cylindrical ram body 51.

The lowermost surface of the lower wireline guide 60 is part circumferential, whilst the uppermost surface of the lower wireline guide 60 is planer and is parallel to the longitudinal axis of the cylindrical ram body 51.

A recess 59 is formed at the centre of the front face of the upper wireline guide 58, and the recess 59 is arranged to be perpendicular to the longitudinal axis of the cylindrical ram body 51. A recess 61 is also formed in the front face of the lower wireline guide 60 and is also arranged to be perpendicular to the longitudinal axis of the cylindrical ram body 51.

The front face of a left hand half 58A of the upper wireline guide 58 extends outwardly at an angle, which may be in the region of 60°, from the junction at which the left hand half 58A meets the recess 59, and the right hand half 58B of the upper wireline guide 58 also extends outwardly at an angle, which may be in the region of 60°, from the junction at which the right hand half 58B meets the recess 59.

The front face of a left hand half 60A of the lower wireline guide 60 extends outwardly at an angle, which may be in the region of 60°, from the junction at which the left hand half 60A meets the recess 61, and the right hand half 60B of the lower wireline guide 60 also extends outwardly at an angle, which may be in the region of 60°, from the junction at which the right hand half 60B meets the recess 61.

Thus, the upper 58 and lower 60 wireline guides provide "V" shaped guiding formations which, as will be described subsequently in use, will guide a wireline into the recesses 59, 61.

Figure 6:
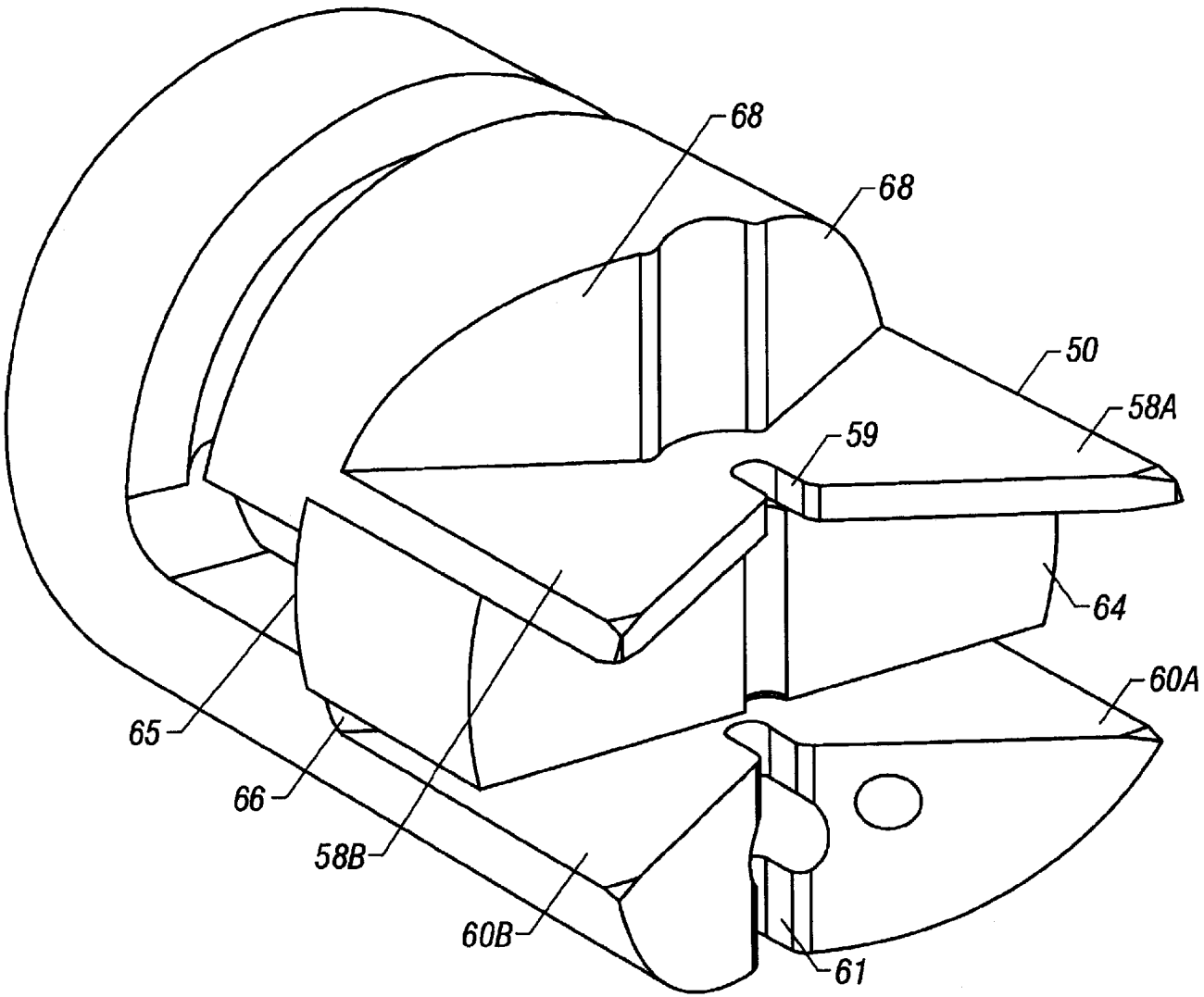
FIG. 6 is a detailed perspective view of the ram assemblies of FIG. 5(*a*).

An inner seal (not shown in FIGS. 5(*a*) to 5(*i*) but shown in FIGS. 6 and 7 as reference numeral 64) is located within the recess provided between the lowermost surface of upper wireline guide 58, uppermost face of lower wireline guide 60 and the innermost end 62. The inner seal 64 may be similar to the inner seal as shown in FIGS. 1 to 3(*b*), and comprises a rubber inner portion bounded by two metal plates which are screwed to the rubber portion. The innermost face of the inner seal 64 comprises a recess which is arranged to be perpendicular to the longitudinal axis of the cylindrical ram body 51, and which is arranged to be aligned with the pair of recesses 59, 61.

It should be noted that a spacer plate 66 is located between the uppermost surface of lower wireline guide 60 and the lowermost surface of the inner seal 64. The spacer plate 66 is arranged in two halves 66A, 66B which join at intersection 66C. The leading (innermost) face of the left hand half 66A tapers at an angle, which may be in the region of 60°, from intersection point 66C toward the end 62, and the leading edge (innermost surface) of the right hand half 66B of the spacer plate 66, tapers at angle, which may be in the region of 60°, from the intersection point 66C toward the end 62. The vertical depth of the spacer plate 66 is substantially identical to the vertical depth of a lower wireline guide 20 of the first (right hand) ram 10.

Figure 8:
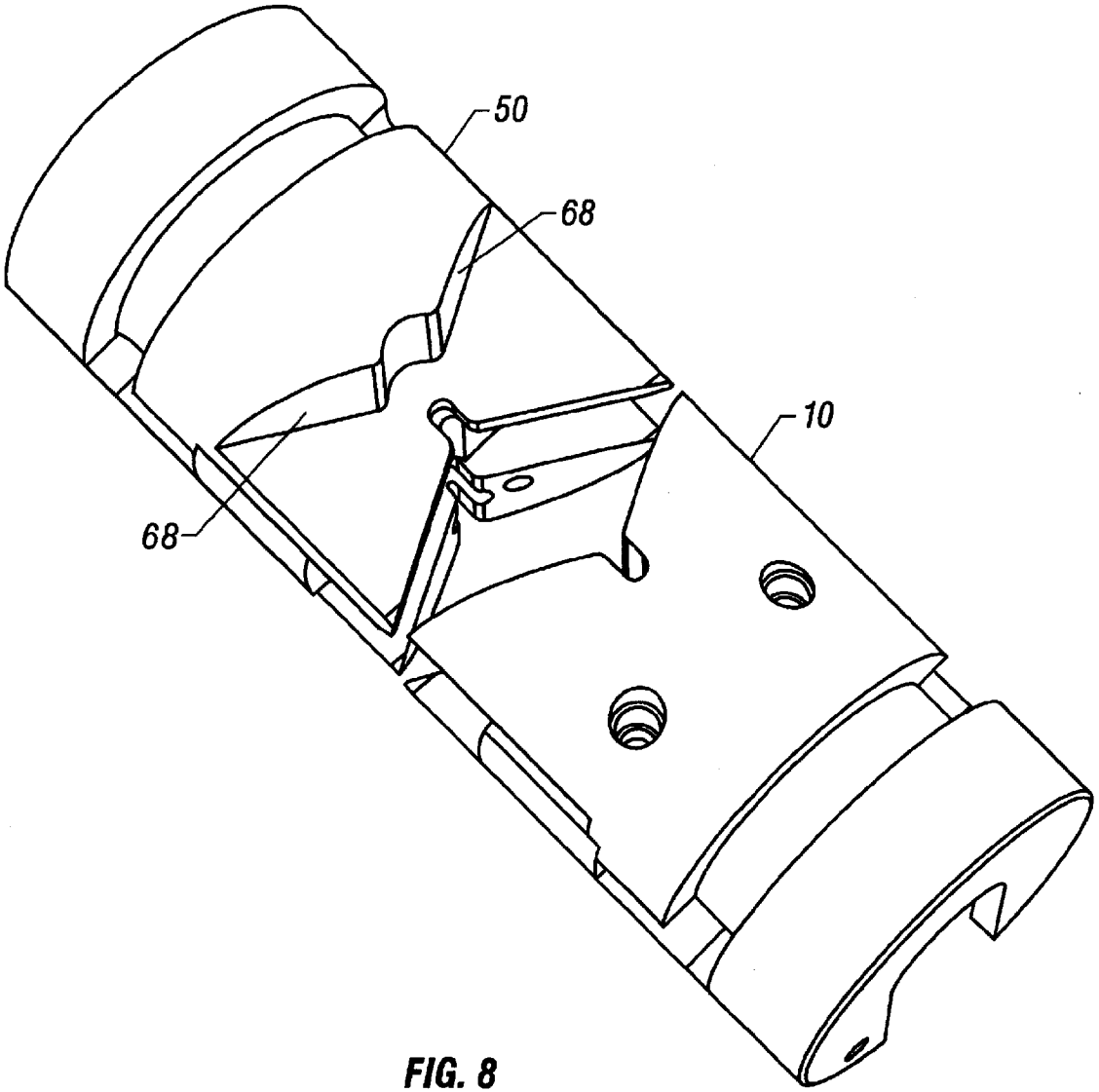
FIG. 8 is a detailed perspective view of the ram assemblies of FIG. 4(*a*) and FIG. 5(*a*) being brought closer together, with the wireline valve omitted for clarity.
Figure 9:
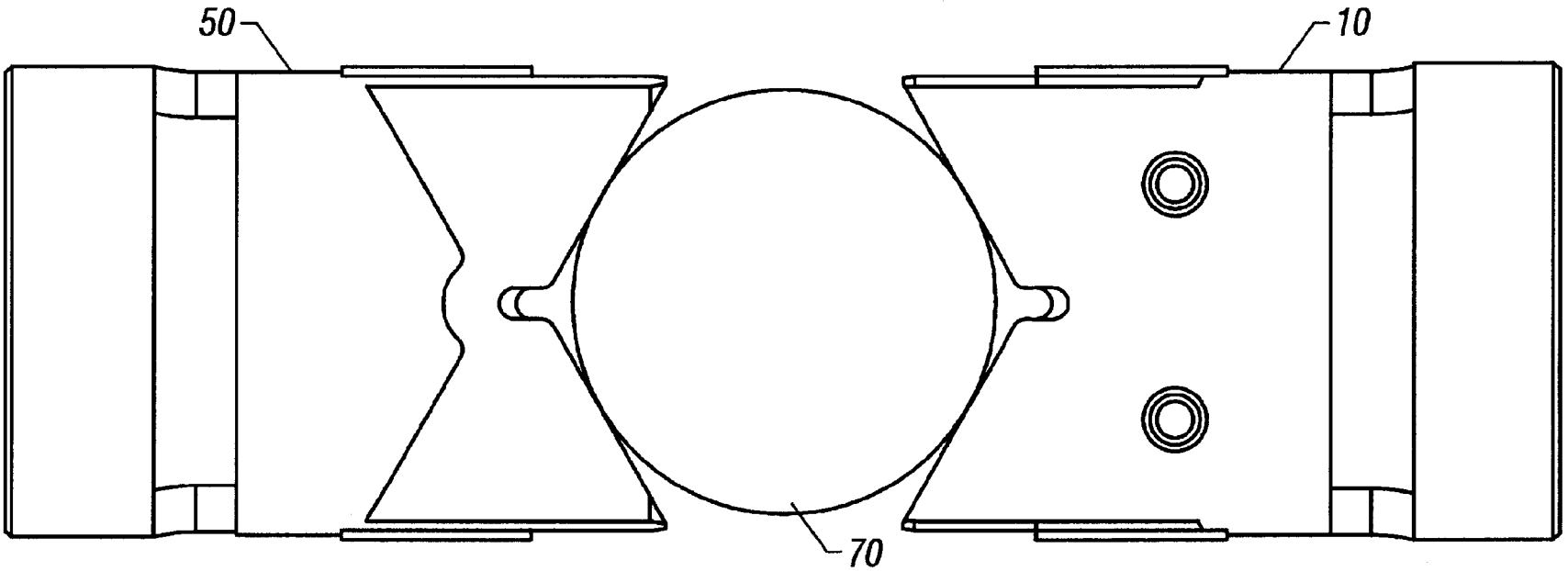
FIG. 9 is a plan view of the ram assemblies of FIG. 4(*a*) and FIG. 5(*a*), shown in spaced apart relation about the throughbore of the wireline valve, with the rest of the wireline valve omitted for clarity.

The pair of rams 10, 50 are placed within the pair of ram bores of the wireline valve (not shown), and in normal operation of the wireline valve, the pair of rams 10, 50 will be located in the position shown in FIG. 9 such that they are not interfering with the throughbore 70 of the wireline valve. However, when intervention is required, such that sealing around the wireline at the point at which it passes through the wireline valve throughbore 70 is required, then the pair of rams 10, 50 are pushed toward one another by respective ram rods (not shown) which are coupled to the respective rams 10, 50 by means of the respective slots 14, 54. The pair of rams 10, 50 are now approaching one another, as shown in FIG. 7 and even closer in FIG. 8. The pair of rams 10, 50 are arranged such that the lowermost surface of the upper wireline guide 18 is arranged to be in a sliding fit with the uppermost surface of the upper wireline guide 58. In addition, the left hand 58A and right hand 58B upper wireline guides of the left hand ram 50 move into the space between the lowermost surface of upper wireline guide 18 and uppermost surface of the inner seal 24. Similarly, the lowermost surface of the lower wireline guide 20 is arranged in a sliding fit with the uppermost surface of the lower wireline guide 60, and the left hand 20A and right hand 20B lower wireline guides of the right hand ram 10 move into the space between the uppermost surface of lower wireline guide 60 and lowermost surface of the inner seal 64.

It should also be noted that the outermost edges of all of the wirelines guides 18, 20, 58, 60 are of a greater width than the throughbore 70 of the wireline valve. This provides the great advantage that the wireline will be picked up by the arrangement of wireline guides 18, 20, 58, 60 and as the pair of rams 10, 50 are moved toward one another, the wireline will be guided until it is located in the recesses 19, 21, 59, 61 and in the circular recess formed between the pair of inner seals 24, 64. It should be noted that this will occur, due to the configuration of upper 18, 58 and lower 20, 60 wireline guides no matter what position that the wireline is originally in, since the "V" shaped wireline guides 18, 20, 58, 60 are inherently configured to guide the wireline into the recesses 19, 21, 59, 61 and recesses formed in the inner seals 24, 64.

The rams 10, 50 continue move toward one another until the leading edge of the lower wireline guide 20 comes to rest against the leading edge of the spacer plate 66. Similarly, the leading edge of the upper wireline guide 58 comes to rest against the leading edge of the spacer plate 26. Similarly, the leading edge of the upper wireline guide 18 will come to rest against a "V" shaped formation 68 which is provided on the front face of the ram 50 above the upper guide 58. Similarly, the leading edge of the lower wireline guide 60 will come to rest against a "V" shaped formation 28 which is provided on the front face of the ram 10 below the lower guide 20. The provision of four guide arms 18, 20, 58, 60 provides the advantage that the wireline is denied the opportunity to touch any part of the rams 10, 50 which is not a guide arm.

Once the two rams 10, 50 have been brought together, the two outer seals, which are located in respective slots 16, 56, of the respective rams 10, 50 can be energised, thus ensuring that the pressure in the wellbore below the wireline valve is retained, and intervention work can then be carried out on the wireline protruding above the wireline valve.

Figure 10C:
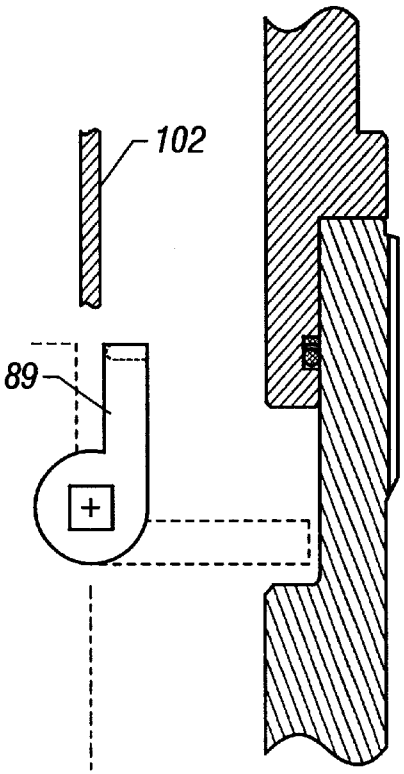
FIG. 10(*a*) is a second embodiment of an apparatus for centralising a wire within a wireline valve in accordance with the present invention.
Figure 10B:
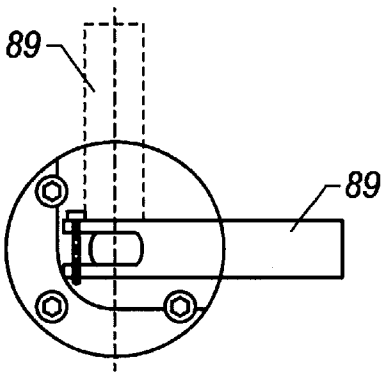
Figure 10A:
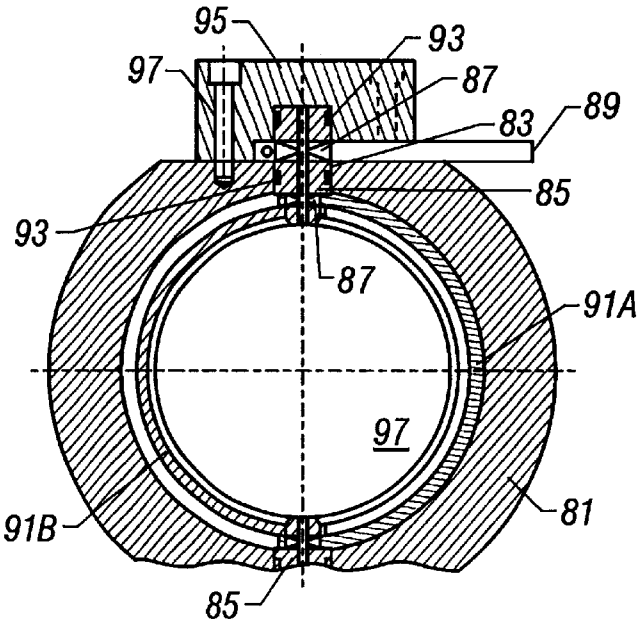

A second apparatus for ensuring that a wireline is centralised within a wireline valve is shown in FIGS. 10(*a*), 10(*b*) and 10(*c*). It should be noted that the apparatus shown in FIGS. 10(*a*) to 10(*c*) is intended to be mounted above and below a conventional wireline valve as shown in FIGS. 1, 2, 3(*a*) and 3(*b*), such that the apparatus as shown in FIGS. 10(*a*) to 10(*c*) can be retrofitted to an existing wireline valve, or can be supplied to a user along with an existing wireline valve.

The apparatus of FIGS. 10(*a*) to 10(*c*) comprises a tubular sub 81, provided with suitable couplings such as screwthread couplings for coupling one tubular sub 81 above the wireline valve and one tubular sub 81 below the wireline valve. The tubular sub 81 is provided with a pair of apertures 83 formed in the sidewall thereof, where the apertures 83 are arranged to be diametrically opposite one another. A cylindrical shaft 85 is located in each of the apertures 83, where the cylindrical shaft 85 has two square recesses 87 formed thereon. A handle 89 having a square aperture therethrough is attached to one of the square recesses 87 of the shaft 85, such that rotation of the handle about the square coupling with the shaft 85 causes the shaft 85 to rotate. A semi-circular guide arm is coupled to the other square recess 87 such that rotation of the shaft causes rotation of the guide arm 91A. The other end of the semi-circular guide arm 91A is held in place by the other shaft 85, but rotation of the other shaft 85 does not cause rotation to occur to the semi-circular guide arm 91A.

The other shaft 85 is secured to a handle (not shown) and is further secured via a similar square recess arrangement to a second semi-circular guide arm 91B, such that rotation of the other handle causes rotation to occur to the other semi-circular guide arm 91B. A shaft end cap 95 holds the shaft 85 in position, where the shaft end cap 95 is secured in place against the outer surface of the tubular sub 81 by means of a suitable bolt 97.

Accordingly, rotation of the two handles 89 in opposite directions causes the two guide arms 91A, 91B to rotate upwardly toward one another such that a wireline 102 is directed toward the very centre of the main throughbore 97 of the tubular sub 81. Accordingly, rotation of both handles 89 of both the upper tubular sub 81 and the lower tubular sub 81 will cause the wireline 102 to be located in the centre of the wireline valve throughbore. Accordingly, the rams of the conventional wireline valve may now be closed without risk of the wireline 102 not locating in the recess in the appropriate inner seal.

It should be noted that the tubular sub 81 is arranged so that the wireline valve rams are orientated so that they close in the plane of the arrow 100.

It should also be noted that the handles may be manually operated, or may be hydraulically driven. In addition, the very centre of the shaft 85 is hollow, and this provides the advantage that the junction between the shaft 85 and the end cap 95 will experience the same pressure as the main throughbore 97 which means that the rotation of the handle 89 should occur more easily. In other words, the shaft 85 is pressure balanced to remove end loads thereon.

In addition, the guide arms preferably have rounded profiles to prevent damage occurring to the wireline 102 and the slot envelope provided by the two guide arms 91A, 91B coming together is large enough to suit the desired wireline 102 size.

Figure 11A:
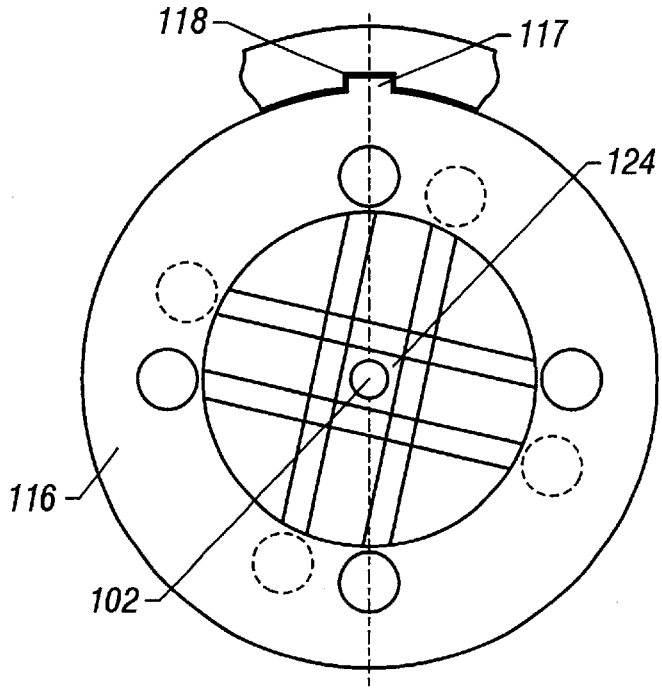
FIG. 11(*a*) is a plan view of a third embodiment of an apparatus for centralising a wire within a wireline valve, in accordance with the present invention.
Figure 11B:
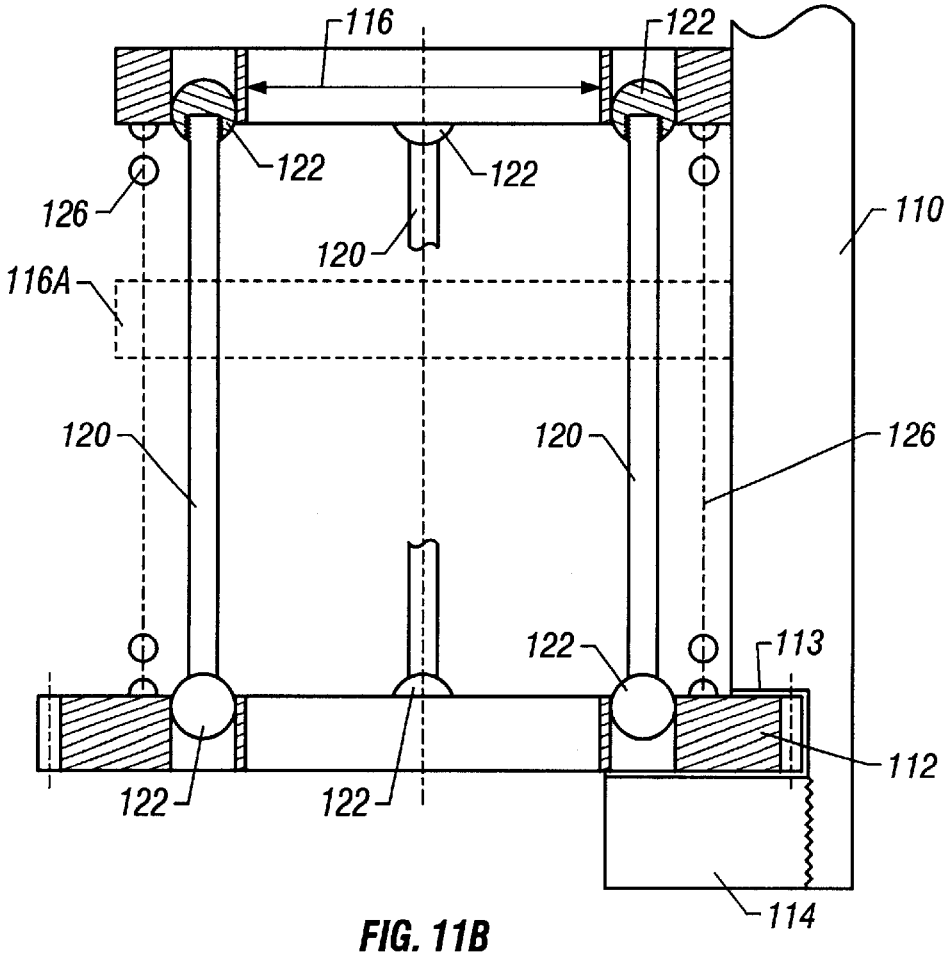

FIGS. 11(*a*) and 11(*b*) show a second alternative embodiment for centralising a wireline 102. This embodiment comprises an outer tubular sub 110, one of which is coupled to the upper end of a wireline valve, and another of which is coupled to a lower end of the wireline valve. A lower plate 112 is mounted within the inner bore of the tubular sub 110 and is retained longitudinally in that position by means of a shoulder 113 of the housing 110, and a threaded retainer ring 114. However, it should be noted that the lower plate 112 is rotatable about the longitudinal axis of the throughbore of the tubular sub 110, and it may be that a thrust washer is located between the lower plate 112 and the shoulder 113 or threaded retainer 114.

An upper plate 116 is mounted within the throughbore of the tubular sub 110, and is provided with a key 117 which protrudes outwardly from its outer radial surface, where the key 117 is arranged to lie in a longitudinally arranged slot 118 formed along the inner surface of the tubular sub 110. Accordingly, the key 117 prevents rotation of the upper plate 116, but permits longitudinal movement of the plate 116 with respect to the housing 110 and the lower plate 112.

The upper plate 116 is coupled to the lower plate 112 via a plurality of rods or wires 120. It is preferred that there at least four rods 120. The rods 120 are each secured to the upper 116 and lower 112 plates via a suitable moveable joint such as spherical joint 122.

Actuation of the apparatus shown in FIGS. 11(*a*) and 11(*b*) causes the lower plate 112 to rotate; this rotational movement can be generated manually through an arrangement of gears, or can be generated by a linear hydraulic piston with the lower plate 112 being keyed into a helical slot formed in the tubular sub 110. This rotation of the lower plate 112 relative to the upper plate 116 causes the rods 120 to take the shortest route across the throughbore of the housing 110 and concurrently, the upper plate 116 is caused to move downwardly toward the lower plate 112 until it reaches its final position as shown in phantom as 116A. Thus, the plurality of rods 120 have caused a cage or envelope 124 about the longitudinal axis of the throughbore of the housing 110, and the wireline 102 is moved by the rods 120 to be located within this square cage/envelope 124. Thus, with one housing 110 being located above a conventional wireline valve and another housing 110 being located below a conventional wireline valve, actuation of both upper 110 and lower 110 housings causes the wireline 102 to be located on the longitudinal axis of the wireline valve and hence the wireline 102 has been centralised on that longitudinal axis. Thus, actuation of the ram assemblies of the wireline valve can now be achieved in the knowledge that the wireline 102 is located on the longitudinal axis of the throughbore of the wireline valve and thus snagging or snapping of the wireline 102 is prevented.

A compression spring 126 is located between the upper 116 and lower 112 plates, and acts therebetween, such that removal of the rotational force to the lower plate 112 will cause the upper plate 116 to return to its starting position, as shown in FIG. 11(*b*).

A third alternative embodiment of the present invention will now be described, but is not shown in the drawings.

A tubular sub, which may be similar to either of those previously described, is located above and below a conventional wireline valve. The tubular sub contains a plurality of fingers which normally reside out of the throughbore of the tubular sub, but which may be actuated in a rotary manner to bring the fingers into the throughbore of the tubular sub and reduce the bore size concentrically to an envelope just larger than the wire diameter. The plurality of fingers thus operate in a manner similar to the principle of a camera iris.

Modifications and improvements may be made to the foregoing embodiments with departing from the scope of the invention. For example, although it is preferred that the wireline guides 18, 20, 58 and 60 are formed integrally with the respective cylindrical ram body, it is possible that the wireline guides 18, 20, 58 and 60 be replaceable, and in this latter scenario, suitable fixing means such as screws or bolts or the like would be used to replaceably secure the wireline guides 18, 20, 58 and 60 to the respective cylindrical ram body.

What is claimed is:

1. An apparatus for moving an elongate member which passes through a throughbore of a valve device, the apparatus comprising an upper centralising mechanism and a lower centralising mechanism spaced apart about a portion of the valve device, the upper and lower centralising mechanisms being actuable such that they are capable of moving the elongate member into a pre-determined position which is substantially co-incident with the longitudinal axis of the valve device, and wherein the upper centralising mechanism comprises two pairs of guide arms which are adapted to move the elongate member toward the longitudinal axis of the valve device.

2. An apparatus according to claim 1, wherein the upper and lower centralising mechanisms are provided within a member having a substantially cylindrical throughbore, wherein the respective members are adapted for coupling to the upper end of the valve device.

3. A valve device comprising an apparatus according to claim 1.

4. An apparatus according to claim 1, wherein the pairs of guide arms are adapted to move the elongate member toward the longitudinal axis of the valve device upon movement of the guide arms in a direction substantially perpendicular to the longitudinal axis of the valve device.

5. An apparatus according to claim 1, wherein one pair of guide arms of the upper centralising mechanism are provided on a first ram assembly, and a second pair of guide arms of the upper centralising mechanism are provided on a second ram assembly.

6. An apparatus according to claim 5, wherein the pair of guide arms of the upper centralising mechanism of one of the ram assemblies is arranged to butt against a portion of the pair of guide arms of the upper centralising mechanism of the other of the ram assemblies.

7. An apparatus according to claim 5, wherein a surface of the pair of guide arms of the upper centralising mechanism of one of the ram assemblies is arranged to be a sliding fit with a surface of the pair of guide arms of the upper centralising mechanism of the other of the ram assemblies.

8. An apparatus according to claim 5, wherein each of the pair of ram assemblies comprises an upper and lower centralising mechanism.

9. An apparatus according to claim 8, wherein the upper and lower centralising mechanism are located immediately about an inner sealing member of the valve device.

10. An apparatus according to claim 5, wherein the first and second ram assemblies are arranged substantially diametrically opposite one another about the longitudinal axis of the throughbore.

11. An apparatus according to claim 10, wherein each of the pair of guide arms of the upper centralising mechanism are arranged about a recess adapted to accept the elongate member therein.

12. An apparatus according to claim 10, wherein each of the pair of guide arms taper outwardly at an angle from the longitudinal axis of the respective ram assembly.

13. An apparatus according to claim 12, wherein said angle is in the region of 60° to 45°.

14. An apparatus according to claim 12, wherein each pair of guide arms of the upper centralising mechanism taper outwardly to an extent at least as great as the diameter of the throughbore of the valve device.

15. An apparatus for moving an elongate member which passes through a throughbore of a valve device, the apparatus comprising an upper centralising mechanism and a lower centralising mechanism spaced apart about a portion of the valve device, the upper and lower centralising mechanisms being actuable such that they are capable of moving the elongate member into a pre-determined position which is substantially co-incident with the longitudinal axis of the valve device, and wherein the lower centralising mechanism comprises two pairs of guide arms which are adapted to move the elongate member toward the longitudinal axis of the valve device.

16. An apparatus according to claim 15, wherein the pair of guide arms of the lower centralising mechanism of one of the ram assemblies is arranged to butt against a portion of the pair of guide arms of the lower centralising mechanism of the other of the ram assemblies.

17. An apparatus according to claim 15, wherein a surface of the pair of guide arms of the lower centralising mechanism of one of the ram assemblies is arranged to be a sliding fit with a surface of the pair of guide arms of the lower centralising mechanism of the other of the ram assemblies.

18. A valve device comprising an apparatus according to claim 15.

19. An apparatus according to claim 15, wherein one pair of guide arms of the lower centralising mechanism are provided on a first ram assembly, and a second pair of guide arms of the lower centralising mechanism are provided on a second ram assembly.

20. An apparatus according to claim 19, wherein the first and second ram assemblies are arranged substantially diametrically opposite one another about the longitudinal axis of the throughbore.

21. An apparatus according to claim 20, wherein each of the pair of guide arms of the lower centralising mechanism are arranged about a recess adapted to accept the elongate member therein.

22. An apparatus according to claim 21, wherein the recesses of the upper centralising mechanism and the recesses of the lower centralising mechanism are arranged to be coincident with the longitudinal axis of a recess of inner sealing member of the valve device.

23. An apparatus according to claim 20, wherein each of the pair of guide arms taper outwardly at an angle from the longitudinal axis of the respective ram assembly.

24. An apparatus according to claim 23, wherein said angle is in the region of 60° to 45°.

25. An apparatus according to claim 23, wherein each pair of guide arms of the lower centralising mechanism taper outwardly to an extent at least as great as the diameter of the throughbore of the valve device.

26. A method of moving an elongate member which passes through a throughbore of a valve device, the method comprising providing an upper centralising mechanism and a lower centralising mechanism spaced apart about a portion of the valve device, the upper and lower centralising mechanisms being actuable such that the elongate member is moved into a pre-determined position which is substantially co-incident with the longitudinal axis of the valve device, the upper centralising mechanism comprising two pairs of guide arms which are adapted to move the elongate member toward the longitudinal axis of the valve device, and actuating the upper and lower centralising mechanism.

27. A method of moving an elongate member which passes through a throughbore of a valve device, the method comprising providing an upper centralising mechanism and a lower centralising mechanism spaced apart about a portion of the valve device, the upper and lower centralising mechanisms being actuable such that the elongate member is moved into a pre-determined position which is substantially co-incident with the longitudinal axis of the valve device and wherein the lower centralising mechanism comprises two pairs of said guide arms, and actuating the upper and lower centralising mechanisms.

* * * * *